US007924246B2

(12) United States Patent
Hara

(10) Patent No.: US 7,924,246 B2
(45) Date of Patent: Apr. 12, 2011

(54) PIXEL CIRCUIT, METHOD OF DRIVING PIXEL, AND ELECTRONIC APPARATUS

(75) Inventor: Hiroyuki Hara, Chino (JP)

(73) Assignee: Seiko Epson Corporation, Tokyo (JP)

( * ) Notice: Subject to any disclaimer, the term of this patent is extended or adjusted under 35 U.S.C. 154(b) by 620 days.

(21) Appl. No.: 11/187,888

(22) Filed: Jul. 25, 2005

(65) Prior Publication Data

US 2006/0066528 A1 Mar. 30, 2006

(30) Foreign Application Priority Data

Sep. 30, 2004 (JP) ..... 2004-288030
Sep. 30, 2004 (JP) ..... 2004-288039
Jun. 6, 2005 (JP) ..... 2005-166024

(51) Int. Cl.
*G09G 3/30* (2006.01)
*G09G 3/32* (2006.01)

(52) U.S. Cl. ..... 345/76; 345/82

(58) Field of Classification Search ..... 345/76–83; 315/169.3
See application file for complete search history.

(56) References Cited

U.S. PATENT DOCUMENTS 6,229,506 B1 5/2001 Dawson et al.
6,650,060 B2 11/2003 Okuda
6,859,193 B1 2/2005 Yumoto
7,002,536 B2 2/2006 Tam
7,145,532 B2 12/2006 Kageyama et al.
7,187,355 B2 3/2007 Tam et al.
7,193,591 B2 3/2007 Yumoto
7,277,070 B2 10/2007 Koyama
7,358,935 B2 4/2008 Yamashita et al.
7,379,039 B2 5/2008 Yumoto
7,388,564 B2 6/2008 Yumoto
2002/0047581 A1* 4/2002 Koyama ..... 315/169.3
2002/0140659 A1* 10/2002 Mikami et al. ..... 345/90
2004/0239599 A1 12/2004 Koyama

FOREIGN PATENT DOCUMENTS

CN 1355664 A 6/2002
EP 1 455 335 A1 9/2004
JP A-2002-189446 7/2002
JP A-2002-215095 7/2002
JP A-2003-022049 1/2003
JP A-2003-150118 5/2003
JP A-2003-216100 7/2003
JP A-2003-241711 8/2003
JP A-2003-330416 11/2003
JP A-2004-510208 4/2004
JP A-2004-151587 5/2004
JP 2004-246320 9/2004
JP A-2005-134462 5/2005
JP A-2005-134546 5/2005
KR 10-2004-0067965 7/2004
WO WO 99/65011 12/1999
WO WO 01/06484 A1 1/2001
WO WO 02/27700 4/2002

* cited by examiner

*Primary Examiner* — Kevin M Nguyen
(74) *Attorney, Agent, or Firm* — Oliff & Berridge PLC

(57) ABSTRACT

A pixel circuit that makes an electro-optical element emit light includes a transistor inserted into a driving current path of the electro-optical element; a current value setting circuit that sets a current value of the driving current path; a level holding unit that stores the level of a supplied image signal; and a comparator circuit that compares the level of the stored image signal with the level of a supplied ramp level signal to control the operation of the transistor on the basis of the comparison result.

6 Claims, 15 Drawing Sheets

PIXEL CIRCUIT, METHOD OF DRIVING PIXEL, AND ELECTRONIC APPARATUS

This application claims the benefit of Japanese Patent Application No. 2004-288039 filed Sep. 30, 2004, Japanese Patent Application No. 2004-288030 filed Sep. 30, 2005 and Japanese Patent Application No. 2005-166024 filed Jun. 6, 2005. The entire disclosures of the prior applications are hereby incorporated by reference herein in their entirety.

BACKGROUND

The present invention relates to a pixel circuit of an electro-optical device for forming an image, to a method of driving the same, and to an electronic apparatus using the electro-optical device.

Known examples of electro-optical devices include a liquid crystal display device and an organic EL (electroluminescent) display device. The organic EL display device has received attention, because it has a structure in which an electro-optical element constituting a pixel is made of an organic EL material to have excellent characteristics, such as capability of emitting natural light, a wide viewing angle, a small thickness, a rapid response, and low power consumption, and can be made small and light by utilizing a peripheral circuit using a polysilicon TFT (thin film transistor).

However, there is luminance deviation among pixels in such an organic EL display device. For this reason, in order to suppress the luminance deviation among pixels, various driving methods based on a current programming method have been suggested (for example, see U.S. Pat. No. 6,229,506 B1).

According to the current programming method, since the TFT is operated in a saturation region of the TFT, it is possible to compensate for characteristic deviation of the TFT and an organic EL light-emitting element (hereinafter, referred to as an 'OLED').

However, in the current programming method according to the related art, there is a problem in that a current supplied to the OLED changes due to an insufficient amount of writing in a low gray-scale region or a change in an operating point of a driving transistor and thus gray-scale deviation occurs.

Accordingly, it is conceivable to provide 'a current-programming-type time gray-scale method'.

This technology discloses a method of driving an electro-optical element in which a data current is supplied to a pixel having a storage capacitor, a driving transistor, and an electro-optical element, and the electro-optical element is driven on the basis of a driving current supplied from the driving transistor in accordance with the value of the data current. The method includes a step of supplying a data current having a predetermined value to the pixel to drive the electro-optical element, irrespective of input gray-scale data, and a step of adjusting the driving time of the electro-optical element on the basis of the gray-scale data. As a result, the insufficient amount of writing and the change in the operating point can be resolved.

However, when the suggested technology is applied to an actual OLED display panel, light-emitting times of pixels constituting a display panel should be individually controlled, so that the control operation or circuit structure becomes complicated.

SUMMARY

An advantage of the invention is that it provides a driving circuit of an electro-optical device capable of simplifying control operation or circuit structure, a driving method of the electro-optical device, and an electronic apparatus having the electro-optical device.

According to a first aspect of the invention, a pixel circuit that makes an electro-optical element emit light includes: a transistor inserted into a driving current path of the electro-optical element; a current value setting circuit that sets a current value of the driving current path; a level holding unit that stores the level of a supplied image signal; and a comparator circuit that compares the level of the stored image signal level with a supplied ramp level signal to control the operation of the transistor on the basis of the comparison result.

Further, according to a second aspect of the invention, a pixel circuit that makes an electro-optical element emit light includes: a transistor inserted into a driving current path of the electro-optical element; a current value setting circuit that sets a current value of the driving current path; and a comparator circuit that extracts one pixel signal from a composite signal including a pixel column signal portion having a series of pixel signals preceding on a time basis and a ramp level signal portion subsequent to the pixel column signal portion and compares the level of the extracted pixel signal with the level of the ramp level signal to control an operation time of the transistor on the basis of the comparison result.

Preferably, the current value setting circuit includes a driving transistor inserted into the driving current path; a current supply source that supplies a current having a predetermined value to the driving transistor; and a capacitor that stores a gate voltage of the driving transistor when the current having the predetermined value is supplied to the driving transistor.

Preferably, the electro-optical element is an organic EL light-emitting element.

Further, according to a third aspect of the invention, there is provided an electronic apparatus including the above-mentioned pixel circuit in an image indicator.

Further, according to a fourth aspect of the invention, a pixel driving method that makes a plurality of pixels two-dimensionally arranged on a substrate emit light includes: setting a current level supplied to each pixel in advance; storing a pixel signal to be displayed by each pixel in each pixel region; and comparing the level of a supplied ramp level signal with the level of the pixel signal of each pixel to control a light-emitting time of each pixel according to the current level.

Further, according to a fifth aspect of the invention, a pixel driving method that makes a pixel emit light includes: setting a current level supplied to a pixel in advance; storing a pixel signal to be displayed by the pixel; and comparing a supplied ramp level signal with the pixel signal of the pixel to control a light-emitting time of the pixel according to the current level.

Further, according to a sixth aspect of the invention, a pixel driving method that makes a plurality of electro-optical elements two-dimensionally arranged on a substrate emit light includes: setting a current level supplied to each electro-optical element in advance; selecting a pixel signal corresponding to an arrangement region of each electro-optical element from a composite signal including a pixel column signal portion having a series of pixel signals preceding on a time basis and a ramp level signal portion subsequent to the pixel column signal portion to store the level of the selected pixel signal; and comparing the level of each pixel signal corresponding to the arrangement region of each electro-optical element with the level of a supplied ramp level signal to control a light-emitting time of each electro-optical element according to the current level.

Further, according to a seventh aspect of the invention, a pixel driving method that makes an electro-optical element emit light includes: setting a current level supplied to the electro-optical element in advance; extracting one pixel signal from a composite signal including a pixel column signal portion having a series of pixel signals preceding on a time basis and a ramp level signal portion subsequent to the pixel column signal portion to store the level of the extracted pixel signal; and comparing the level of the stored pixel signal with the level of the ramp level signal to control a light-emitting time of the electro-optical element according to the set current level.

BRIEF DESCRIPTION OF THE DRAWINGS

The invention will be described with reference to the accompanying drawings, wherein like numbers reference like elements, and wherein.

DETAILED DESCRIPTION OF EMBODIMENTS

In the invention, when a pixel of an electro-optical element is driven, a current level supplied to each pixel is previously set by a current programming method, and an image signal to be displayed by each pixel is stored in each pixel region. Next, a ramp level signal is supplied for every pixel, so that it is compared with the image signal level of each pixel. Then, a light-emitting time of each pixel is controlled according to the predetermined current level on the basis of the comparison result. As a result, a multiple indicator can be operated through a relatively simple control sequence.

First Embodiment

Hereinafter, preferred embodiments of the invention will be described with reference to the accompanying drawings.

Figure 1:
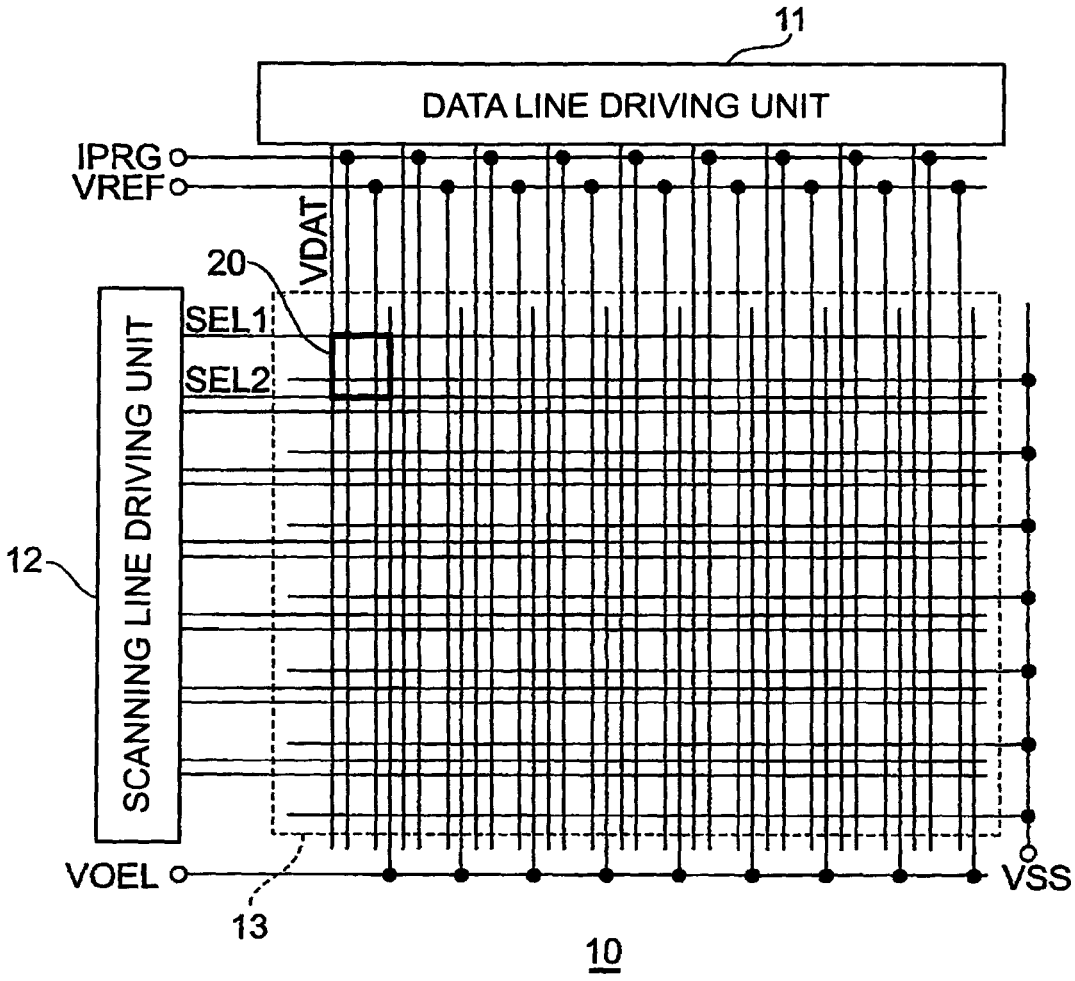
FIG. 1 is a block diagram illustrating an example of an organic EL display device.

FIG. 1 is a block circuit diagram showing the electrical connections of an organic EL display device, which is an example of an electro-optical device of the invention. In FIG. 1, an organic EL display device 10 includes a data line driving unit 11, a scanning line driving unit 12, and an active matrix unit 13. The active matrix unit 13 has a structure in which a plurality of pixel circuits 20, which will be described below, are arranged in a matrix. The data line driving unit 11 supplies, to each pixel circuit 20, an analog data signal VDAT corresponding to the luminance of each pixel of an image. The scanning line driving unit 12 supplies a writing selection signal SEL1 and a light-emitting selection signal SEL2 to the pixel circuits 20 of each row. In addition, each pixel circuit 20 is supplied with a predetermined program current IPRG and a reference potential VREF from a signal source (not shown), and is supplied with a power supply voltage VOEL of an OLED from a power supply.

As described below, a pixel circuit group of each row in the active matrix unit 13 is sequentially selected by the scanning line driving circuit 12, and the signal level VDAT corresponding to the light-emitting time is written in the pixel circuit group of each row by the data line driving unit. The signal level VDAT held in each pixel circuit is compared with a ramp voltage level VREF supplied to each pixel circuit, thereby determining the light-emitting time of the OLED serving as a pixel.

Figure 2:
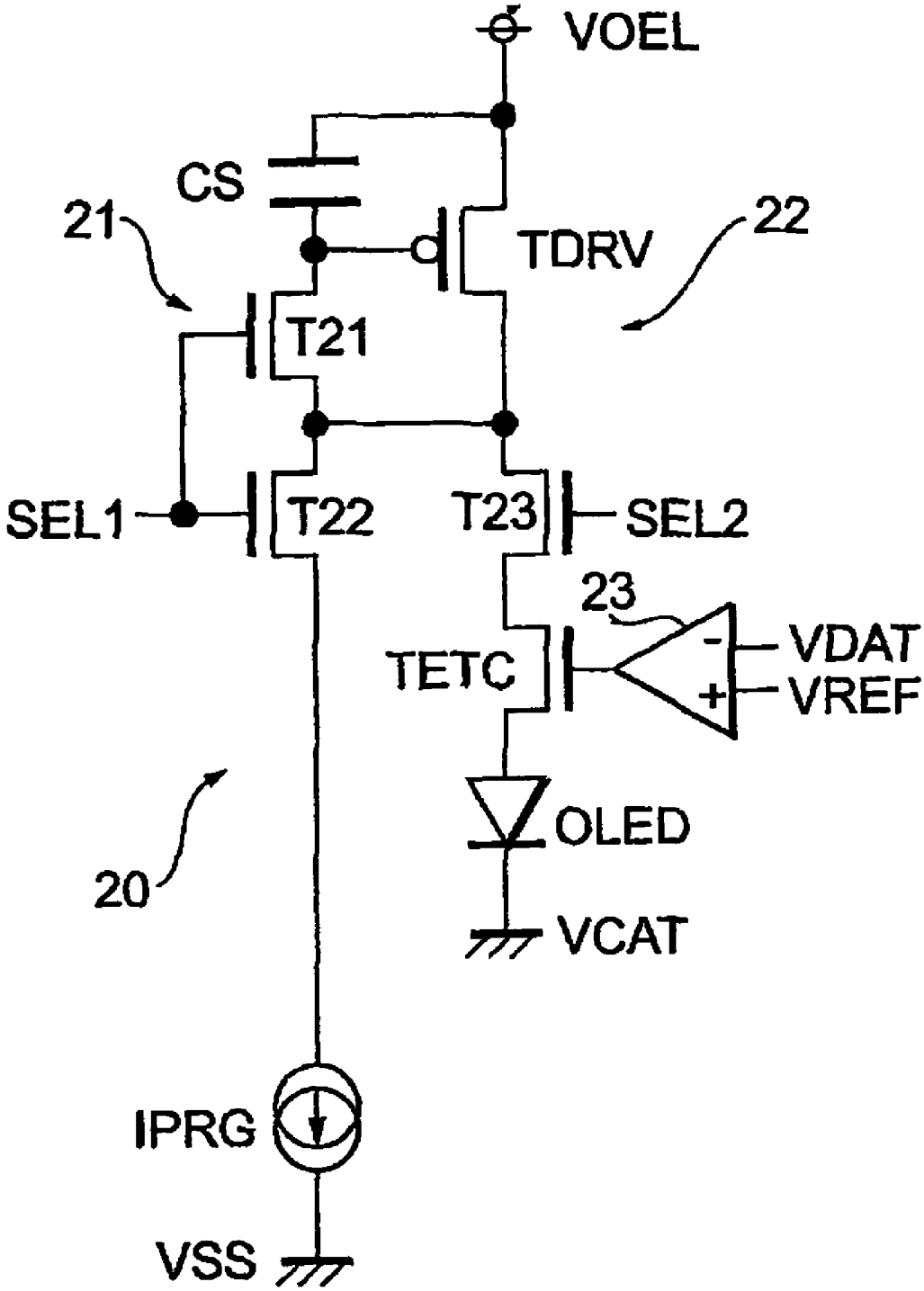
FIG. 2 is a circuit diagram illustrating an example of a pixel driving circuit of the invention.

FIG. 2 shows the structure of the above-mentioned pixel circuit 20. The pixel circuit 20 includes a current programming circuit 21 for achieving the current programming, a driving circuit 22 for driving the OLED, and a comparator circuit 23. The transistor used in each circuit is a thin film transistor (TFT).

The current programming circuit 21 includes a storage capacitor CS, and NMOS (N-channel MOS) transistors T21 and T22, which are connected in series between the organic EL power supply voltage VOEL and the programming current source IPRG. The terminals of the storage capacitor CS are connected to a gate electrode and a source electrode of a driving transistor TDRV of the driving circuit 22, which will be described below. A common connection portion between the transistors T21 and T22 is connected to a drain electrode of the PMOS driving transistor TDRV, and the gate electrode of both transistors is supplied with the writing selection signal SEL1.

The driving circuit 22 includes the PMOS transistor TDRV, an NMOS transistor T23 having a gate electrode supplied with the light-emitting selection signal SEL2, a light-emitting time control NMOS transistor TETC having a gate connected to the comparator circuit 23, and the OLED, which are connected in series between the organic EL power supply voltage source VOEL and a cathode voltage source VCAT.

In the current programming circuit 21, when the writing selection signal SEL1 becomes an on state (H level) and the light-emitting selection signal SEL2 becomes an off state (L level), the transistors T21 and T22 are supplied with power, and the driving transistor TDRV is diode-connected. When a programming current IPR flows into the driving transistor TDRV from the programming current source IPRC; the gate voltage of the transistor TDRV to which the current IPR flows is stored in the storage capacitor CS. As a result, the light-emitting current of the OLED can be set.

The reference potential VREF and the analogue data signal VDAT of the pixel corresponding to the light-emitting time are input to the comparator circuit 23. The comparator circuit 23 has an output terminal connected to the gate terminal of the light-emitting time control transistor TETC. The comparator circuit 23 allows its output to be an H level during a period for which the data signal VDAT exceeds the reference potential VREF of the ramp voltage. In addition, when the transistor TETC is a PMOS transistor, the comparator circuit 23 allows its output to be an L level during the period for which the data signal VDAT exceeds the reference potential VREF of the ramp voltage.

Figure 3:
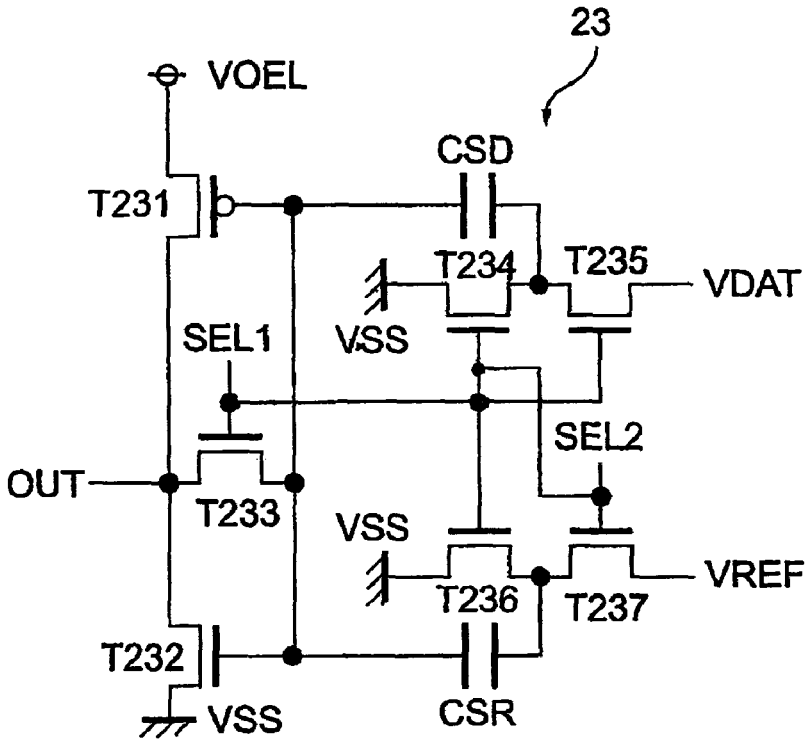
FIG. 3 is a circuit diagram illustrating an example of a comparator circuit used in the pixel driving circuit of FIG. 2.

FIG. 3 shows the structure of the comparator circuit 23. As shown in FIG. 3, a PMOS transistor T231 and an NMOS transistor T232 are connected in series between the organic EL power supply voltage VOEL and a power supply VSS (0 V) through an output terminal OUT. In addition, NMOS transistors T234 and T235 are connected in series between an input terminal VDAT and the power supply VSS. A data signal storage capacitor CSD is connected between a connection point between the transistors T234 and T235 and the gate of the transistor T231. Further, NMOS transistors T237 and T236 are connected in series between an input terminal VREF and the power supply VSS. A reference potential storage capacitor CSR is connected between a connection point between the transistors T237 and T236 and the gate of the transistor T232. The gates of the transistors T231 and T232 are connected to each other, and are connected to the output terminal OUT through an NMOS transistor T233.

The gates of the transistors T233, T235, and T236 are supplied with the writing selection signal SEL1. The gates of the transistors T234 and T237 are supplied with the light-emitting selection signal SEL2.

Figure 4:
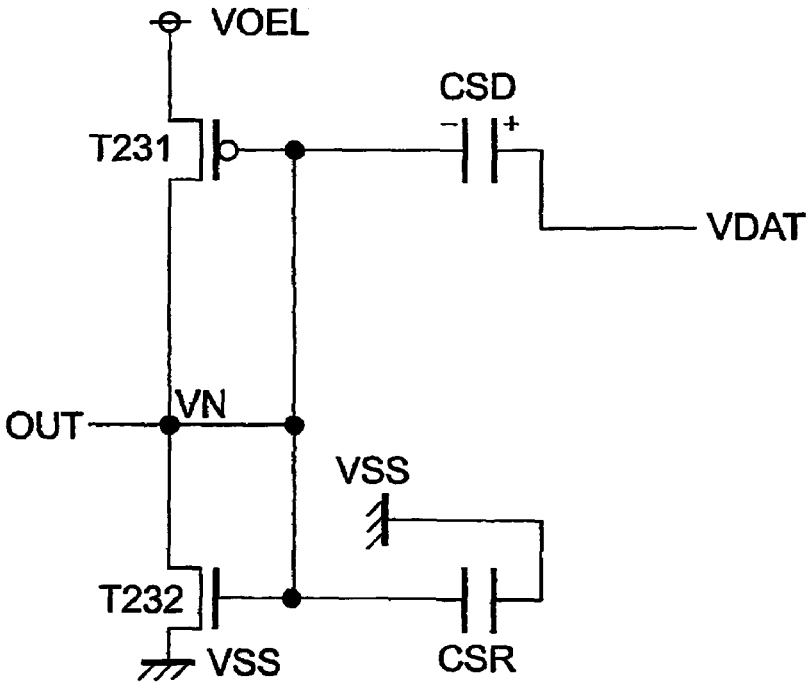
FIG. 4 is a diagram illustrating the operation of the comparator circuit (SEL1; H level and SEL2; L level)

When the writing selection signal SEL1 supplied to the comparator circuit 23 becomes an 'H' level and the light-emitting selection signal SEL2 supplied to the comparator circuit 23 becomes an 'L' level, the comparator circuit 23 allows the transistors T233, T235, and T236 to be a connection state and allows the transistors T234 and T237 to be in a nonconnection state, as shown in FIG. 4. The data storage capacitor CSD is charged by the analog data signal VDAT supplied to the VDAT terminal, and stores the level of the data signal. On the other hand, the reference potential storage capacitor CSR has one end connected to the power source VSS. The output of the comparator circuit 23 becomes an inverter center VN determined by characteristics of a CMOS inverter.

Figure 5:
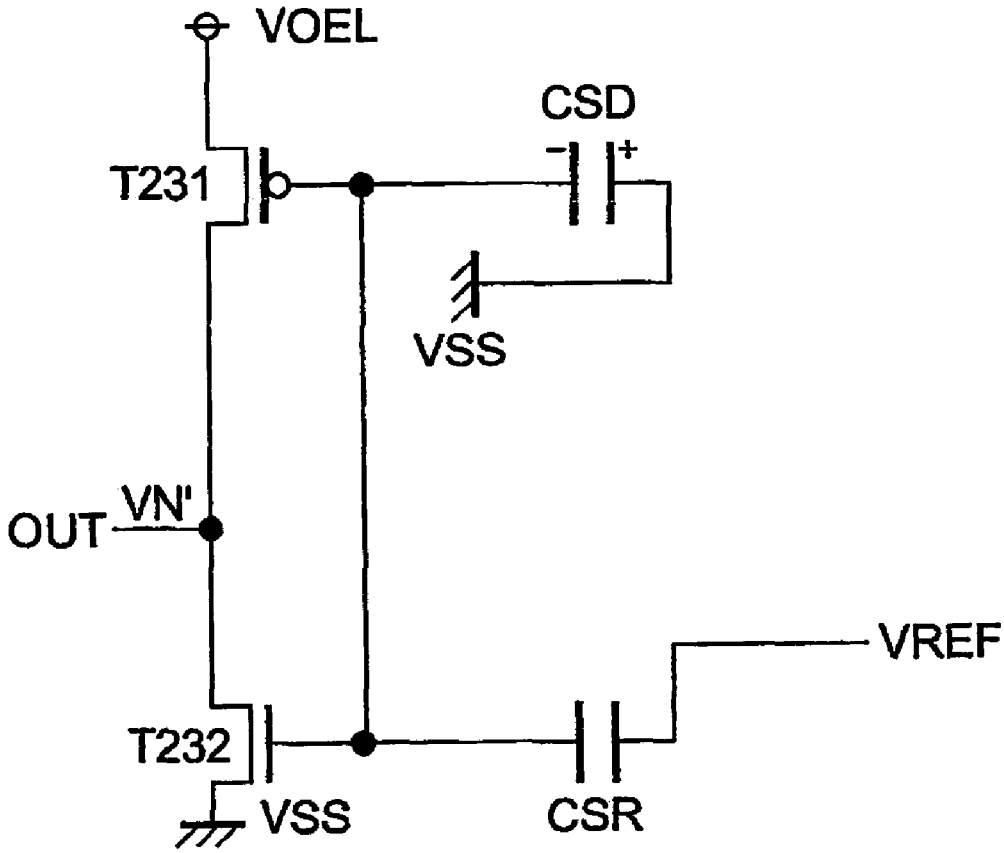
FIG. 5 is a diagram illustrating the operation of the comparator circuit (SEL1; L level and SEL2; H level)

In addition, when the writing selection signal SEL1 becomes an 'L' level and the light-emitting selection signal SEL2 becomes an 'H' level, the comparator circuit 23 allows the transistors T233, T235, and T236 to be in a nonconnection state and allows the transistors T234 and T237 to be in a connection state, as shown in FIG. 5. The reference potential storage capacitor CSR and the data storage capacitor CSD are connected in series between the input terminal VREF and the power supply VSS. In this case, the data storage capacitor CSD is connected between the input terminal VREF and the power supply VSS in a state in which the polarity of an electric charge is reversed. In addition, connection points between the reference potential storage capacitor CSR and the data storage capacitor CSD become input terminals of a CMOS inverter, which is formed of the PMOS transistor T231 and the NMOS transistor T232.

In an initial state, the input of the CMOS inverter becomes the inverter center VN, and maintains an intermediate state. As a result, a load current circuit of the OLED is formed, so that a display element emits light.

Next, when the reference potential signal VREF is supplied to the input terminal, the reference potential storage capacitor CSR is charged, the negative electric charge of the data storage capacitor CSD is offset, and the input of the CMOS inverter changes to forward bias. When the values of the data storage capacitor CSD and the reference potential storage capacitor CSR are equal to each other, the input VN' of the CMOS inverter is given VN'=VN+0.5 (VREF−VDAT). When the level of the reference potential signal VREF exceeds the level stored in the data storage capacitor CSD, the input of the CMOS inverter becomes a positive voltage level. In addition, the transistor T231 enters a nonconnection state and the transistor T232 enters a connection state. As a result, the power supply VSS (L level) is output from the output terminal OUT. When the L level is output through the output terminal OUT, the transistor TETC enters a nonconnection state, so that the load current circuit of the OLED is opened. The display element flickers.

As described above, the comparator circuit 23 allows the analog data signal VDAT to be stored in the storage capacitor CSD and allows the reference potential VREF to be stored in the storage capacitor CSR. In addition, when the data signal VDAT is larger than the reference potential VREF, the output OUT becomes an H level. In contrast, when the data signal VDAT is smaller than the reference potential VREF, the output OUT becomes an L level. As described above, the output OUT of the comparator circuit 23 becomes the gate input of the transistor TETC. Therefore, it is possible to control the light-emitting time of the OLED in accordance with the level of the analog data signal VDAT supplied to the pixel.

Figure 6:
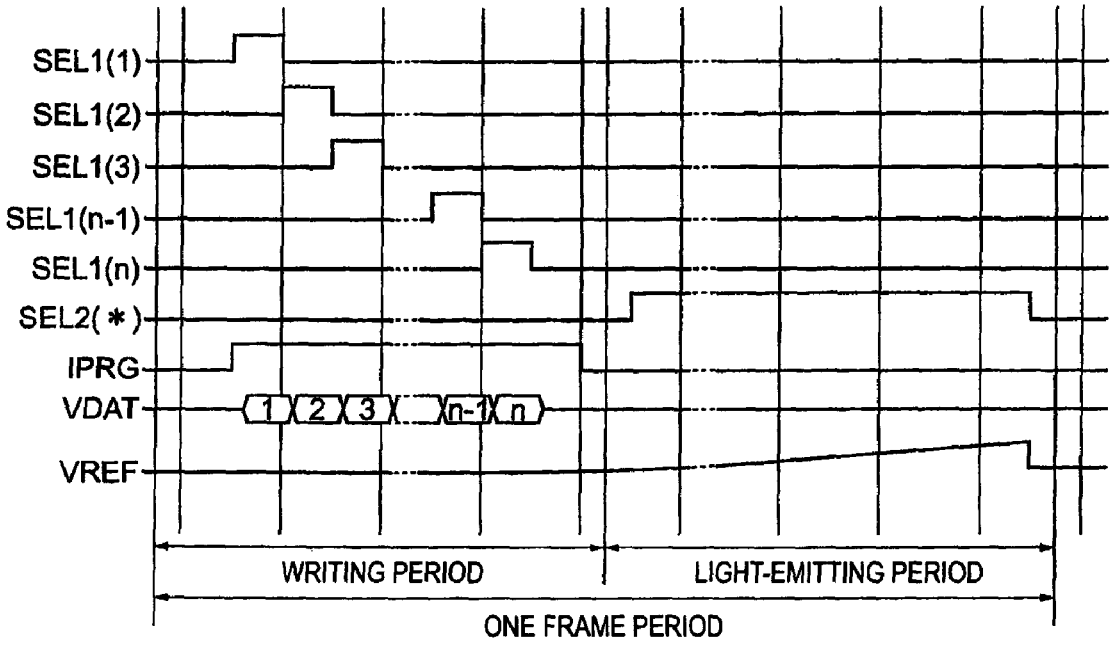
FIG. 6 is a timing chart illustrating the operation of the pixel driving circuits arranged in a matrix.

FIG. 6 is a timing chart illustrating a series of operations from the writing of the data signal to the light emission. Here, the writing selection signals SELL are supplied for n rows so as to correspond to the active matrix unit 13. In addition, the light-emitting selection signals SEL2 are supplied for n rows, but only a light-emitting selection signal SEL2 (*) corresponding to one row is shown in the drawing. For the analog data signal VDAT output from the data line driving unit 11, only a signal corresponding to one column of the active matrix unit 13 is shown in the drawing. In addition, since the reference potential VREF has a waveform common to each pixel, only one signal is shown in the drawing.

As shown in FIG. 6, one frame period, which corresponds to a display processing period of one frame of the image, is divided into a writing period and a light-emitting period. During the writing period, which is the first half of one frame period, the scanning line driving unit 12 sets the levels of the writing selection signals SEL1 (1) to SEL1 (*n*) to L levels sequentially. The data line driving unit 11 supplies the analog data signal VDAT to the respective rows of pixel circuits in synchronization with the writing selection signals SEL1 (1) to SEL1 (*n*), and stores the signal level of the analog data signal VDAT into the storage capacitor CSD of each pixel. During the writing period, each pixel is supplied with the programming current IPRG, and as described above, the gate voltage is stored in the storage capacitor CS, in which the gate voltage is required in order that the driving transistor TDRV allows the programming current IPRG to flow by the operation of the driving circuit corresponding to the supply of the writing selection signal SEL1 and the light-emitting selection signal SEL2.

During the light-emitting period, which is the second half of one frame period, the respective rows of light-emitting selection signals SEL2 (1) to SEL2 (*n*) (shown by the SEL2 (*) in FIG. 6) become an H level simultaneously, the light-emitting selection signals of all pixels become an H level, and the reference potential VREF is supplied to the storage capacitor CSR (see FIG. 5). In this embodiment, the reference potential VREF is a sweep signal whose level increases with time. The comparator circuit performs the comparison between the reference potential VREF and the analog data signal VDAT stored in the previous writing period.

When the data signal VDAT is larger than the reference potential VREF, the output OUT of the comparator circuit becomes an H level and the light-emitting time control transistor TETC enters an on state. As a result, the programming current IPRG stored in the writing period is supplied to the OLED, and the OLED enters a light-emitting state. On the other hand, when the data signal VDAT is smaller than the reference potential VREF, the output OUT of the comparator circuit enters an off state. As a result, the OLED is not supplied with the programming current IPRG and becomes a non-light-emitting state. Since the reference potential VREF functions as the sweep signal, it is possible to control the light-emitting time of the OLED in accordance with the magnitude of the data signal VDAT stored in the writing period.

Second Embodiment

Figure 7:
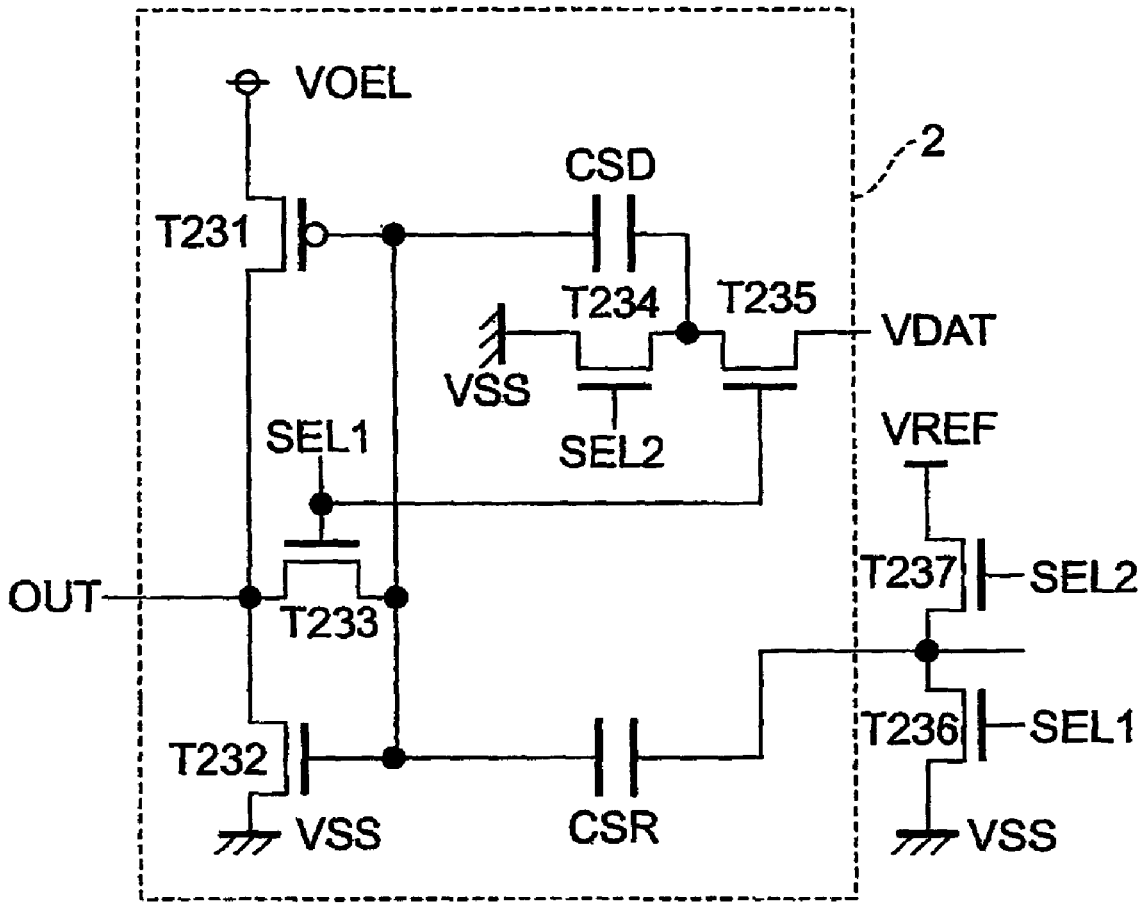
FIG. 7 is a circuit diagram illustrating an example of another comparator circuit.

The structure of the comparator circuit is not limited to one shown in FIG. 2. For example, as shown in FIG. 7, the transistors T236 and T237 of the plurality of transistors can be commonly used in a plurality of pixels. In FIG. 7, the same constituent elements as those in FIG. 3 are denoted by the same reference numerals. In this embodiment, the operation of a comparator circuit is the same as that of the comparator circuit shown in FIG. 3, and thus a description thereof will be omitted. In the second embodiment, the comparator circuit may have a different structure so long as the operation thereof is the same.

Third Embodiment

Figure 8:
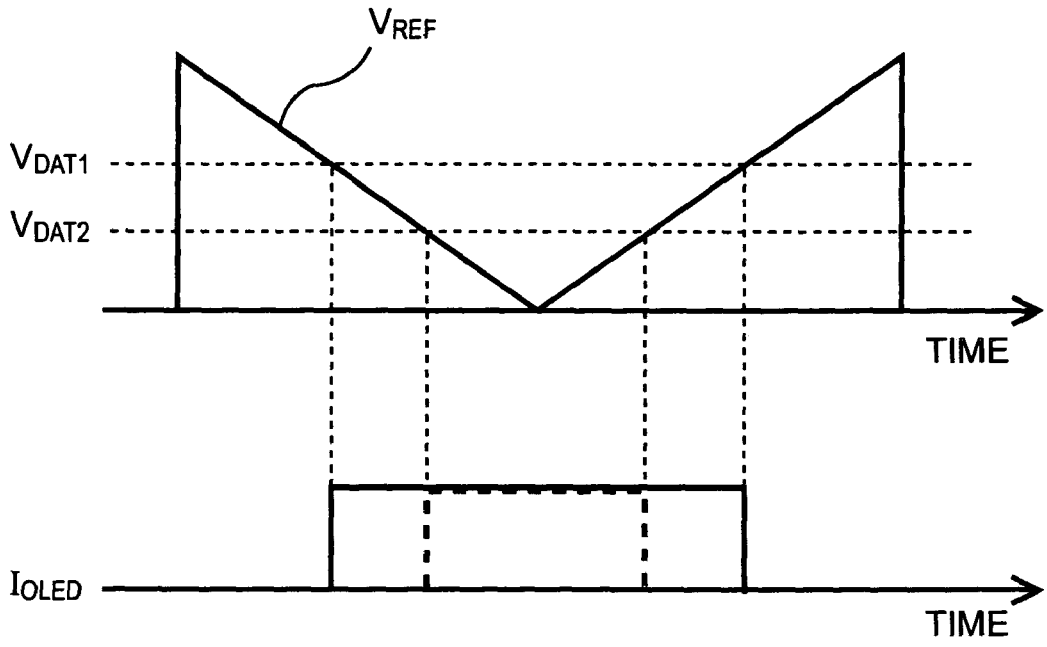
FIG. 8 is a graph illustrating an example of a signal waveform of VREF.

A reference potential supplied to a comparator circuit may use various reference potentials. In FIG. 8, an M-shaped signal waveform of which a signal level becomes the minimum at a central portion of one frame period is used as a reference potential VREF. Although the reference potential VREF is a sweep signal, it is possible to control a supply time (light-emitting time) of a light-emitting current IOLED of an OLED in accordance with a signal level of an analog data signal VDAT stored in a data storage capacitor CSD.

Figure 9:
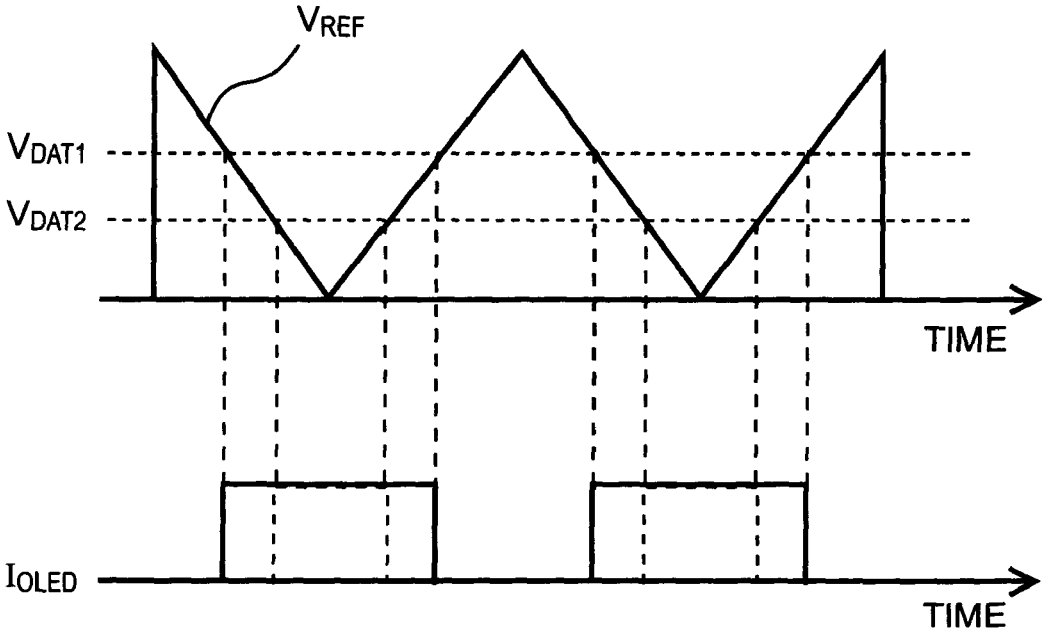
FIG. 9 is a graph illustrating an example of another signal waveform of VREF.

In addition, in an example of the reference potential supplied to the comparator circuit as shown in FIG. 9, a W-shaped signal waveform is used as the reference potential VREF, in which locations where a signal level becomes the minimum is two during one frame period. By using such a sweep signal, it is possible to further minutely control the supply time (light-emitting time) of the light-emitting current IOLED of the OLED. That is, it is possible to decrease the time interval between the time when the OLED emits light and the time when the OLED does not emit the light. As a result, when an image is reproduced, visually smooth image display can be achieved.

In addition, although not shown, a saw tooth-shaped signal waveform may be used as the reference potential VREF.

According to the above-mentioned embodiments, when the OLED is driven through a time-sharing gray scale method using the current programming, the comparator is used as a time control unit, so that gray-scale control of the respective pixels constituting an active matrix can be simultaneously performed. It is possible to suppress the gray scale deviation occurring in the current programming method of the related art while avoiding the complicated control operation of the respective circuits.

In addition, by using the pixel driving circuit according to the above-mentioned embodiments, a method of driving the pixel can be performed which includes a process of previously setting the current level supplied to each pixel, a process of storing the image signal to be displayed by each pixel in each pixel region, a process of comparing the supplied lamp level signal with the image signal level of each pixel, a process of controlling the light-emitting time of each pixel in accordance with the current level, and a process of making the plurality of pixels two-dimensionally arranged on the substrate emit light.

Fourth Embodiment

A fourth embodiment of the invention will be described with reference to FIGS. 10 to 13.

In the fourth embodiment, a light-emitting time control transistor (TFT) is provided in a current path of an electro-optical element of a pixel circuit. A gate and a drain of the light-emitting time control transistor are short-circuited, and an analog signal corresponding to a light-emitting time is stored in each pixel circuit at the same time when storing a threshold value. A reference potential (sweep signal) is supplied to all pixel circuits at the same time, the on/off operation of the light-emitting time control transistor is controlled according to the magnitude relationship between the analog signal and the reference potential, and the light-emitting time of the electro-optical element of each pixel circuit is controlled.

Figure 10:
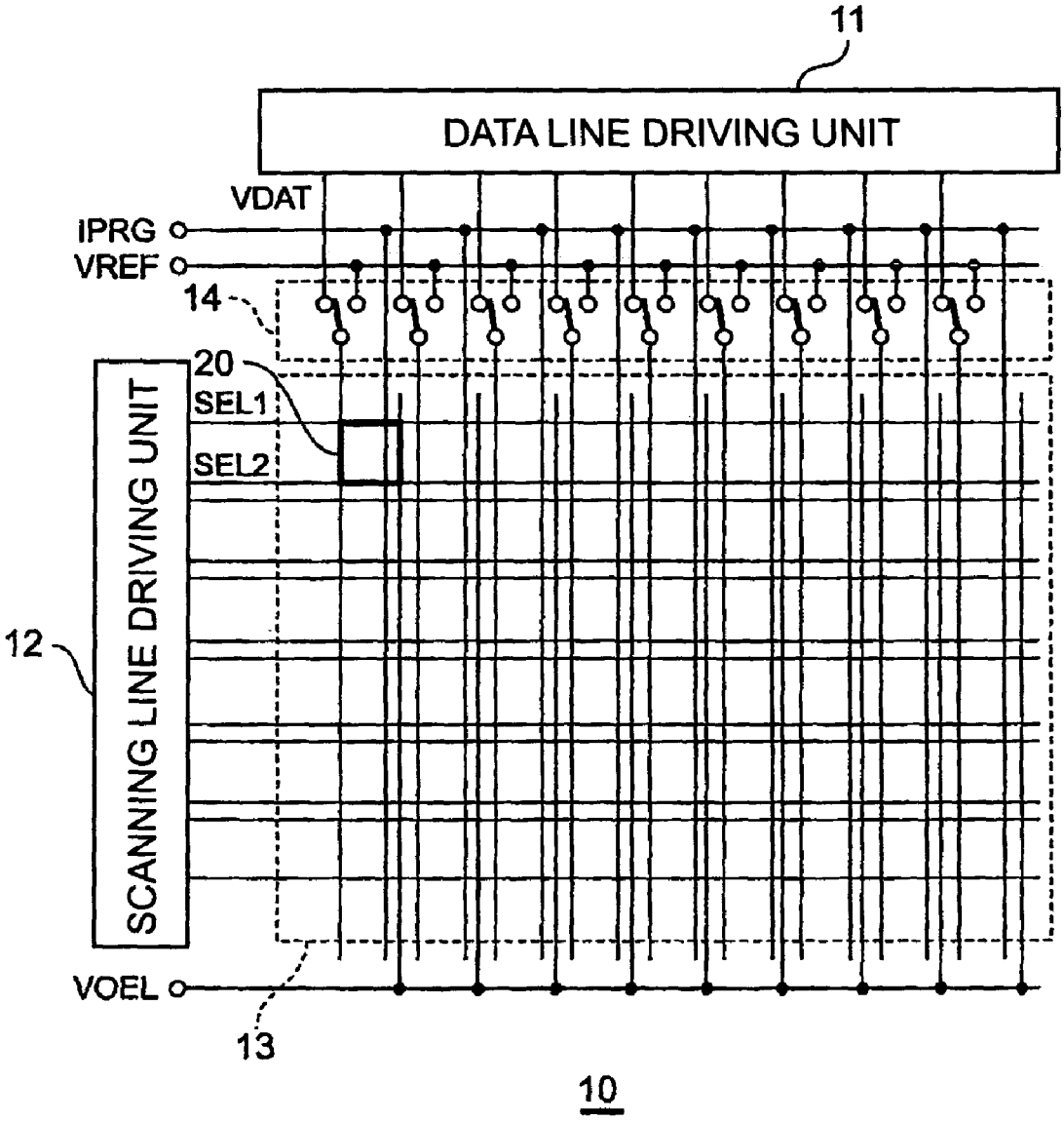
FIG. 10 is a block diagram illustrating an example of an electro-optical device (organic EL display device)

FIG. 10 is a block circuit diagram showing an electric connection of an organic EL display device 10, which is an example of an electro-optical device of the invention. In FIG. 10, the organic EL display device 10 includes a data line driving unit 11, a scanning line driving unit 12, an active matrix unit 13, and a switching unit 14. The active matrix unit 13 has a structure in which a plurality of pixel circuits (described below) 20 are arranged in a matrix. The data line driving unit 11 outputs an analog data signal VDAT corresponding to the luminescence of each pixel of an image. The switching unit 14 selectively switches the analog data signal VDAT and a reference potential VREF output from a signal source (not shown) to supply them to the respective pixel circuits 20. The scanning line driving unit 12 supplies a writing selection signal SEL1 and a light-emitting selection signal SEL2 to each row of pixel circuits 20. In addition, each pixel circuit 20 is supplied with a predetermined programming current IPRG from a current source (described below) and a power supply voltage VOEL of an OLED from the power supply.

The scanning line driving unit 12 sequentially selects a pixel circuit group of each row of the active matrix unit 13. At this time, the switching unit 14 selects the output of the data line driving unit 11, and writes the signal level VDAT corresponding to the light-emitting time of each pixel onto the pixel circuit group of each row. When writing pixel data (analog data signal) onto all pixel circuits 20 is finished, the switching unit 14 selects the reference potential VREF to supply it to all pixel circuits 20. The signal level VDAT held in each pixel circuit 20 is compared with a ramp voltage level VREF supplied to each pixel circuit 20, so that the light-emitting time of the OLED serving as the pixel is determined.

Figure 11:
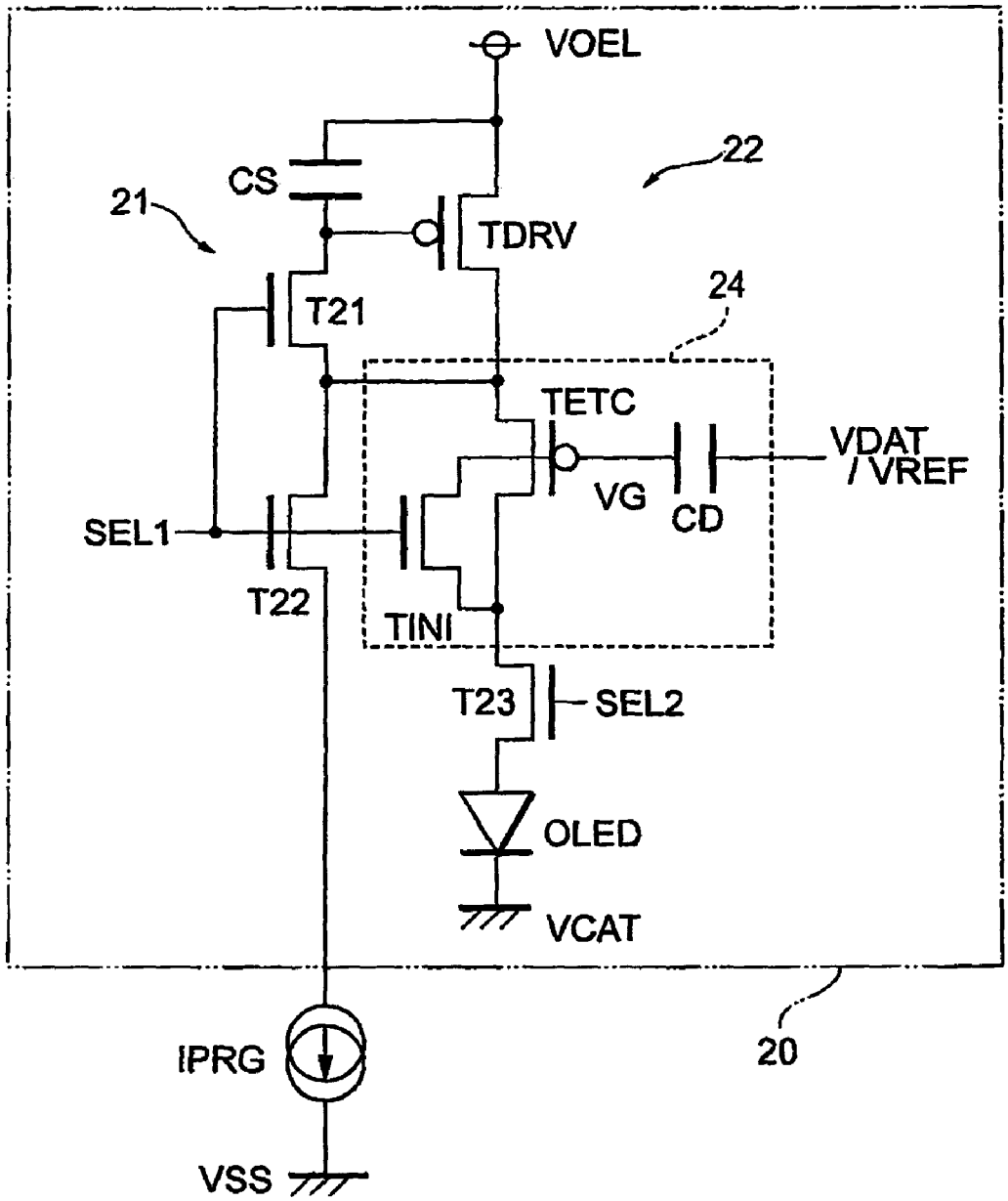
FIG. 11 is a circuit diagram illustrating an example of a pixel circuit according to a first embodiment of the invention.

FIG. 11 shows the structure of the above-mentioned pixel circuit 20. The pixel circuit 20 includes a current programming circuit 21 for achieving current programming, a driving circuit 22 for driving the OLED, and a PMOS inverter circuit 24. A transistor used in each circuit is a thin film transistor (TFT).

The current programming circuit 21 includes a storage capacitor CS and NMOS transistors T21 and T22, which are connected in series between an organic EL power supply voltage VOEL and a programming current source IPRG Both terminals of the storage capacitor CS are connected between a gate and a source of a driving transistor TDRV of a driving circuit 22, which will be described below. A common connection portion between the transistors T21 and T22 is connected to a drain of the PMOS driving transistor TDRV, and gates of both transistors are supplied with the writing selection signal SEL1.

The driving circuit 22 includes the PMOS transistor TDRV, an NMOS transistor T23 having a gate supplied with the light-emitting selection signal SEL2, and the OLED, which are connected in series between the organic EL power supply voltage source VOEL and a cathode voltage source VCAT.

The PMOS inverter circuit 24 includes a light-emitting time control transistor TETC provided in a current path of the OLED, a threshold initializing transistor TINI connected between a gate and a drain of the light-emitting time control transistor TETC, and a data signal storage capacitor CD connected to a gate of the light-emitting time control transistor TETC. The light-emitting time control transistor TETC is supplied with a composite signal VDAT/VREF through the data signal storage capacitor CD. A gate of the threshold value initializing transistor TINI is supplied with the writing selection signal SEL1.

As described below, the PMOS inverter circuit 24 functions as a level comparator to compare the level of the analog data signal VDAT with the level of the reference potential VREF.

The composite signal VDAT/VREF includes an analog data signal (VDAT) portion for assuming pixel column data in the first half of one frame period and a reference potential VREF portion which is a ramp level signal (sweep signal) in the second half of one frame period (see FIG. 12, which is described below).

In the PMOS inverter circuit 24, when the analog signal VDAT is smaller than the reference potential VREF, the light-emitting time control transistor TETC becomes a connection state. When the analog signal VDAT is larger than the reference potential VREF, the light-emitting time control transistor TETC becomes a nonconnection state.

In the current programming circuit 21, when the writing selection signal SEL1 becomes an on state (H level) and the light-emitting selection signal SEL2 becomes an off state (L level), the transistors T21 and T22 are supplied with power, and the driving transistor TDRV is diode-connected. When a programming current IPR flows into the driving transistor TDRV from the programming current source IPRG, a gate voltage (threshold voltage) of the transistor TDRV to which the current IPR flows is stored in the storage capacitor CS. As a result, the light-emitting current of the organic EL display device can be set.

Figure 12:
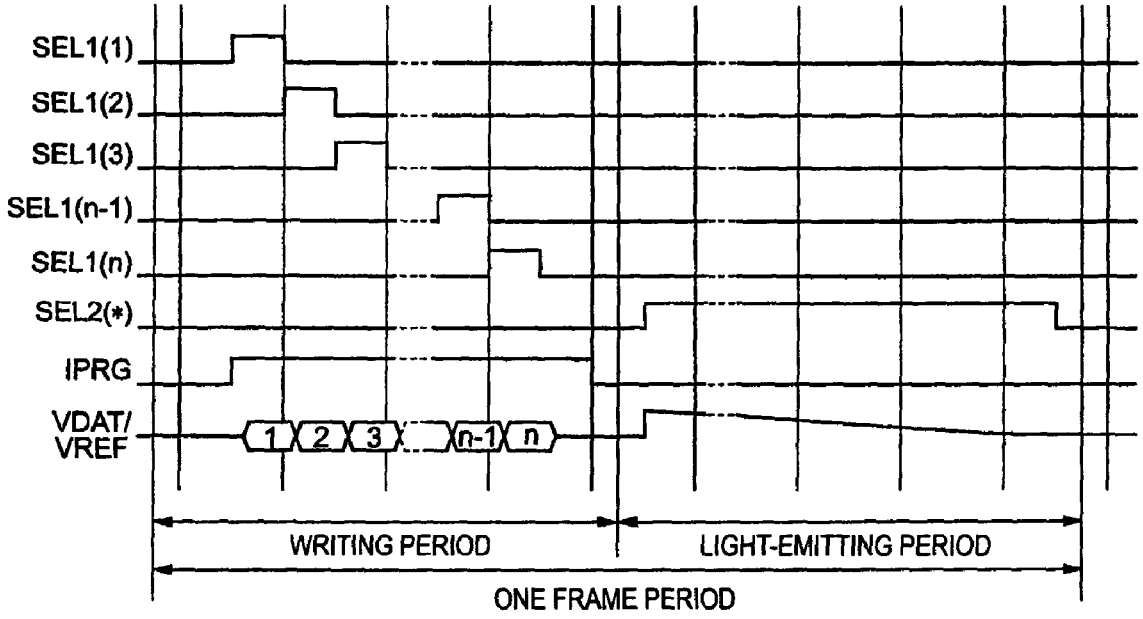
FIG. 12 is a timing chart illustrating signals supplied to the pixel circuit of FIG. 11.

FIG. 12 is a timing chart illustrating a series of operations from the writing of the data signal to the light emission. Here, the writing selection signals SEL1, which are outputs of the scanning line driving unit 12, are supplied for n rows so as to correspond to the active matrix unit 13. In addition, the light-emitting selection signals SEL2 are supplied for n rows, but only a light-emitting selection signal SEL2 (*) corresponding to one row is shown in the drawing. For the composite signal VDAT/VREF output from the switching unit 14, only a signal corresponding to one column of the active matrix unit 13 is shown in the drawing.

As shown in FIG. 12, one frame period, which corresponds to a display processing period of one frame of an image, is divided into a writing period which is the first half of one frame period and a light-emitting period which is the second half of one frame period. During the writing period, the scanning line driving unit 12 sequentially sets respective rows of writing selection signals SEL1 (1) to SEL1 (*n*) to an L level.

Figure 13A:
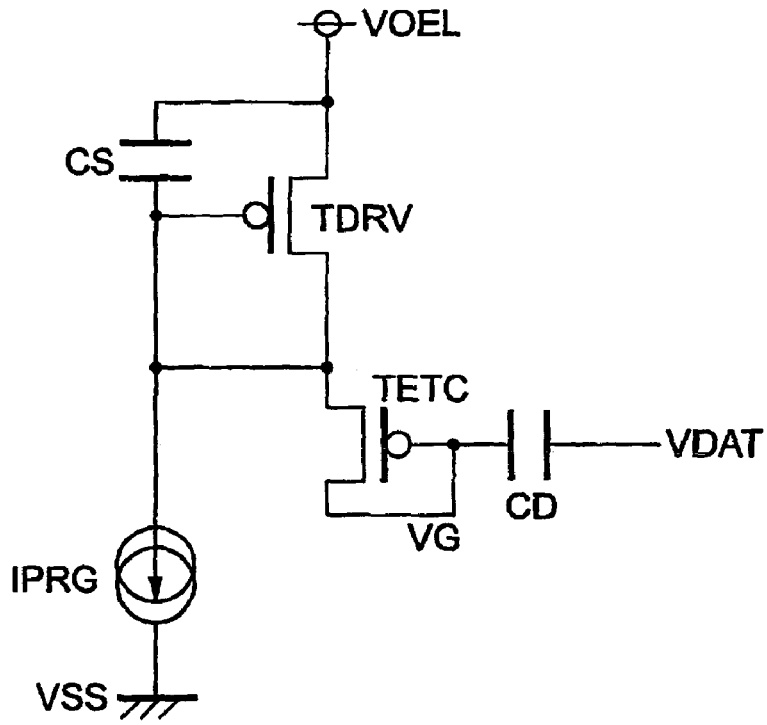
FIG. 13A is an explanatory view illustrating the operation of the pixel circuit in a case in which a signal SEL1 has an 'H' level and a signal SEL2 has an 'L' level.

As shown in FIG. 13A, the threshold value initializing transistor TINI is supplied with power, the gate and drain of the light-emitting time control transistor TETC are short-circuited, and a threshold value is generated at a gate voltage VG of the light-emitting time control transistor TETC which is diode-connected.

In addition, the switching unit 14 supplies the analog data signal VDAT of the composite signal to each row of pixels in synchronization with the writing selection signals SEL1 (1) to SEL1 (*n*), and allows the signal level of the analog data signal VDAT to be stored in the storage capacitor CSD of each pixel. During the writing period, each pixel is supplied with the programming current IPRG As described above, the gate voltage is stored in the storage capacitor CS, in which the gate voltage is required in order that the driving transistor TDRV allows the programming current IPRG to flow by that the transistors T21 and T22 are supplied with power and the transistor T23 is not supplied with power, corresponding to the H level of the writing selection signal SEL1 and the L level of the light-emitting selection signal SEL2.

As shown in FIG. 12, during the light-emitting period which is the second half of one frame period, the respective rows of light-emitting selection signals SEL2 (1) to SEL2 (*n*) (shown by the SEL2 (*) in FIG. 12) become an H level simultaneously, the light-emitting selection signals SEL2 of all pixels become an H level, and the reference potential VREF of the composite signal VDAT/VREF is supplied to the storage capacitor CD by the switching operation of the switching unit 14. In this embodiment, the reference potential VREF is a sweep signal whose level decreases with the passage of time.

The PMOS inverter circuit 24 determines the operation of the light-emitting time control transistor TETC according to the magnitude relationship between the analog data signal VDAT and the reference potential VREF stored in the data signal storage capacitor CD during the previous writing period.

Figure 13B:
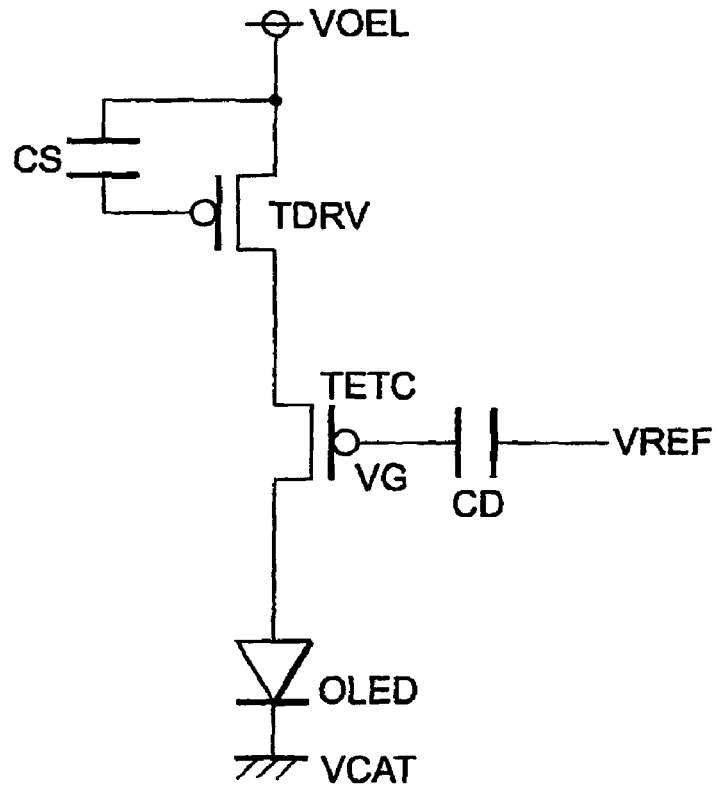
FIG. 13B is an explanatory view illustrating the operation of the pixel circuit in a case in which the signal SEL1 has an 'L' level and the signal SEL2 has an 'H' level.

When the data signal VDAT is smaller than the reference potential VREF, the light-emitting time control transistor TETC becomes a connection state, as shown in FIG. 13B. As a result, the programming current IPRC; which is stored during the writing period, is supplied to the OLED, so that the OLED becomes a light-emitting state.

On the other hand, when the data signal VDAT is larger than the reference potential VREF, the light-emitting time control transistor TETC becomes a non-conductive state. As a result, the programming current IPRG is not supplied to the OLED, so that the OLED becomes a non-emitting state.

In the present embodiment, since the reference potential VREF serves as the sweep signal, it is possible to control the light-emitting time of the OLED according to the magnitude of the data signal VDAT stored in the writing period.

As such, a pixel driving method according to the present embodiment includes a process of previously setting a current level to be supplied to each electro-optical element (program current method), a process of selecting an image signal corresponding to an arrangement region of each electro-optical element from a composite signal including a pixel column signal portion having a series of preceding pixel signals on a time basis and a lamp level signal portion subsequent to the preceding image signals to store the level of the image signal, and a process of comparing the level of each image signal corresponding to the arrangement region of each electro-optical element with the level of the supplied ramp level signal to control the light-emitting time of each electro-optical element according to the current level.

Fifth Embodiment

Figure 14:
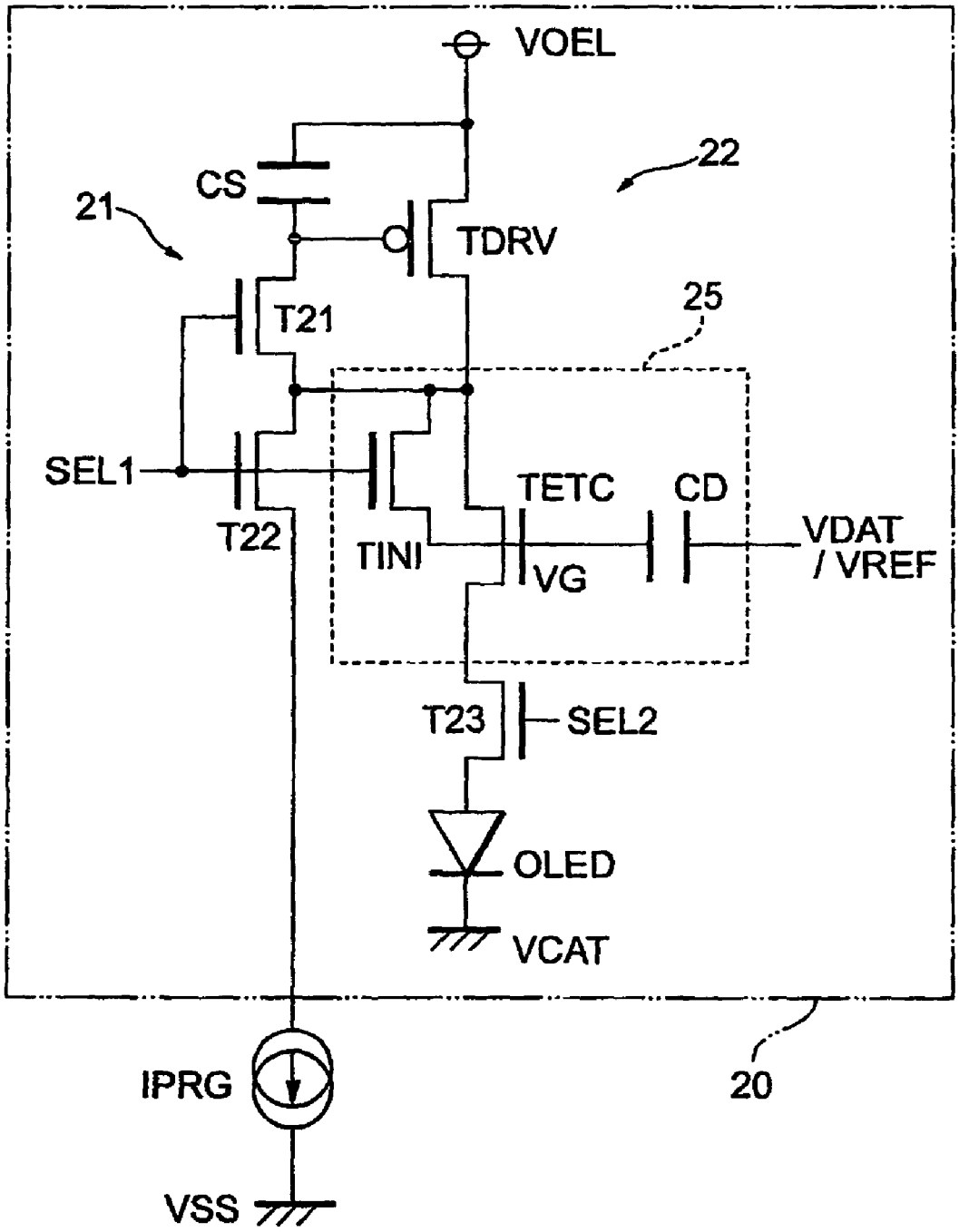
FIG. 14 is a circuit diagram illustrating a pixel circuit according to a second embodiment of the invention.
Figure 15:
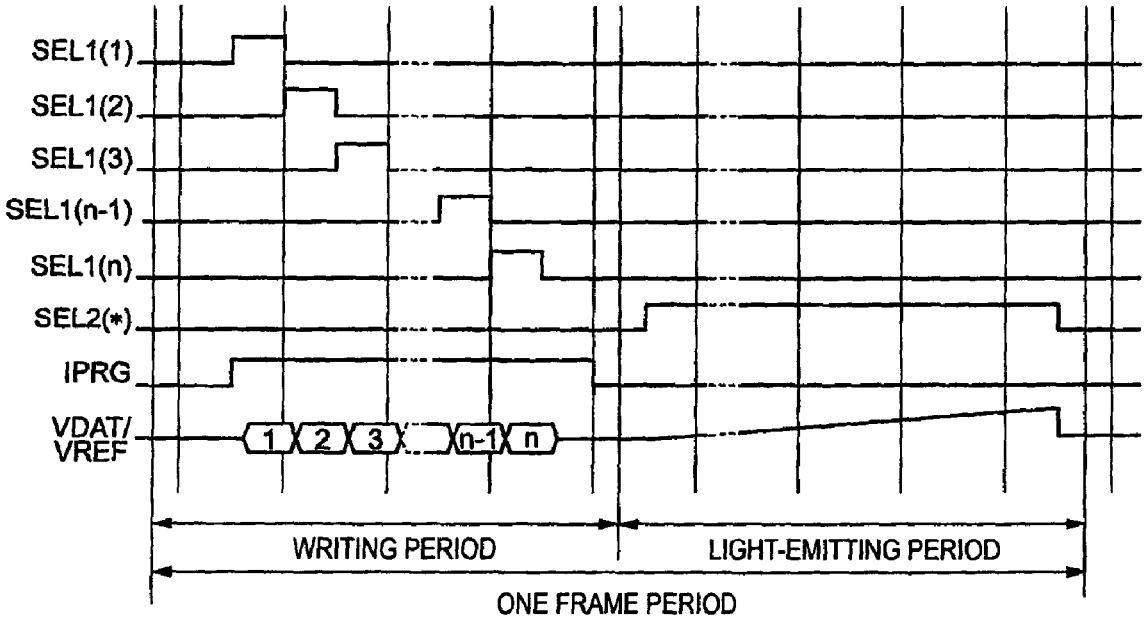
FIG. 15 is a timing chart illustrating signals supplied to the pixel circuit of FIG. 14.

FIGS. 14 and 15 show a fifth embodiment of the invention. In FIG. 14, in a pixel circuit 20, constituent elements corresponding to the constituent elements of the pixel circuit 20 shown in FIG. 11 are denoted by the same reference numerals, and a description thereof will be omitted.

In the fifth embodiment, the PMOS inverter circuit 24 according to the fourth embodiment is constructed by an NMOS inverter circuit 25. The NMOS inverter circuit 25 includes a light-emitting time control NMOS transistor TETC, a threshold value initializing transistor TINI connected between a gate and a drain of the light-emitting time control transistor TETC, and a data signal storage capacitor CD. The other structure of the circuit is the same as that shown in FIG. 11.

When an analog signal VDAT is larger than a reference potential VREF, the NMOS inverter circuit 25 allows the light-emitting time control transistor TETC to become a connection state. In contrast, when the analog signal VDAT is smaller than the reference potential VREF, the NMOS inverter circuit 25 allows the light-emitting time controlling transistor TETC to become a nonconnection state.

Accordingly, as shown in the timing chart of FIG. 15, a direction in which the sweep of the reference potential VREF is changed becomes opposite to that of the fourth embodiment (in an increasing direction). Thus, even when the NMOS inverter circuit 25 is used, it is possible to obtain the same operation as the pixel circuit 20 of the fourth embodiment.

According to the above-mentioned embodiments, when the OLED is driven by a time division gray-scale method using the current programming, one-sided channel inverter is applied as a time control unit, so that it is possible to simultaneously perform gray-scale control of the respective pixels constituting an active matrix. It is possible to suppress the gray scale deviation occurring in the current programming method of the related art while avoiding the complicated control operation of the respective circuits. In addition, it is possible to drastically reduce the number of elements and the number of wiring lines, as compared to the case in which a two-input comparator circuit is used as the light-emitting time control unit, and it is possible to easily obtain the aperture ratio, which is an important factor to a display device. The reduction of the number of elements used is preferable from the viewpoint of improving the reliability.

In addition, by using the pixel driving circuit according to the above-mentioned embodiments, a pixel driving method of making a plurality of electro-optical elements two-dimensionally arranged on a substrate emit light can be achieved which includes a process of previously setting a current level supplied to each electro-optical element, a process of selecting an image signal corresponding to an arrangement region of each electro-optical element from a composite signal including a pixel column signal portion having a series of preceding pixel signals on a time basis and a lamp level signal portion subsequent to the preceding image signals to store the level of the image signal, and a process of comparing the level of each image signal corresponding to the arrangement region of each electro-optical element with the level of the supplied ramp level signal to control the light-emitting time of each electro-optical element according to the current level.

Sixth Embodiment

FIGS. 16A to 16F and 17A and 17B show examples of an electronic apparatus to which the above-mentioned electro-optical device (image indicator) can be applied.

Figure 16A:
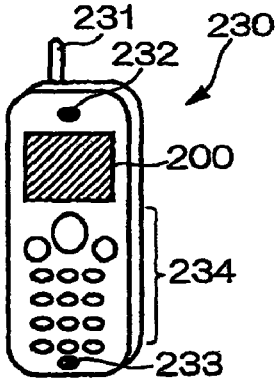
FIGS. 16A to 16F are diagrams illustrating examples of an electronic apparatus to which an electro-optical device can be applied.

FIG. 16A shows a cellular phone to which the above-mentioned electro-optical device is applied. A cellular phone 230 includes an antenna unit 231, a voice outputting unit 232, a voice inputting unit 233, an operation unit 234, and an electro-optical device 200 according to the invention. As such, the electro-optical device according to the invention can be used as a display unit.

Figure 16B:
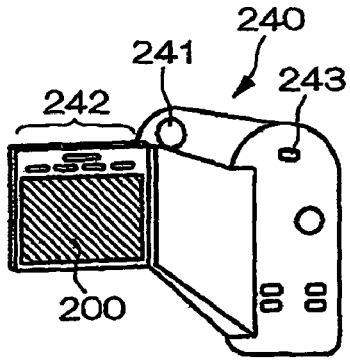

FIG. 16B shows a video camera to which the above-mentioned electro-optical device is applied. A video camera 240 includes a receiving unit 241, an operation unit 242, a voice inputting unit 243, and the electro-optical device 200 according to the invention.

Figure 16C:
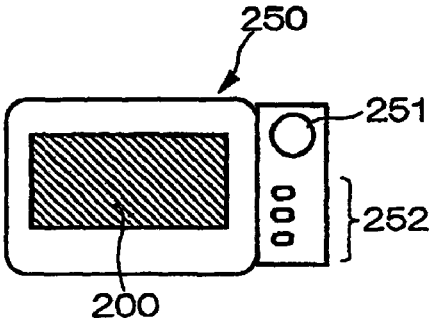

FIG. 16C shows a portable personal computer (a so-called PDA) to which the above-mentioned electro-optical device is applied. A portable personal computer 250 includes a camera unit 251, an operation unit 252, and the electro-optical device 200 according to the invention.

Figure 16D:
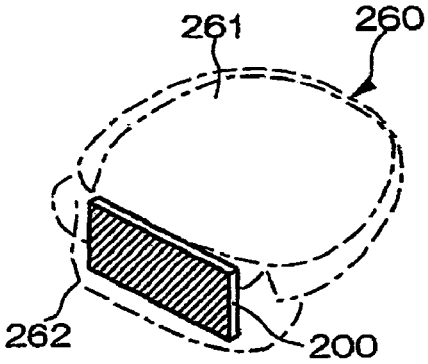

FIG. 16D shows a head mount display to which the above-mentioned electro-optical device is applied. A head mount display 260 includes a band 261, an optical system accommodating portion 262, and the electro-optical device 200 according to the invention.

Figure 16E:
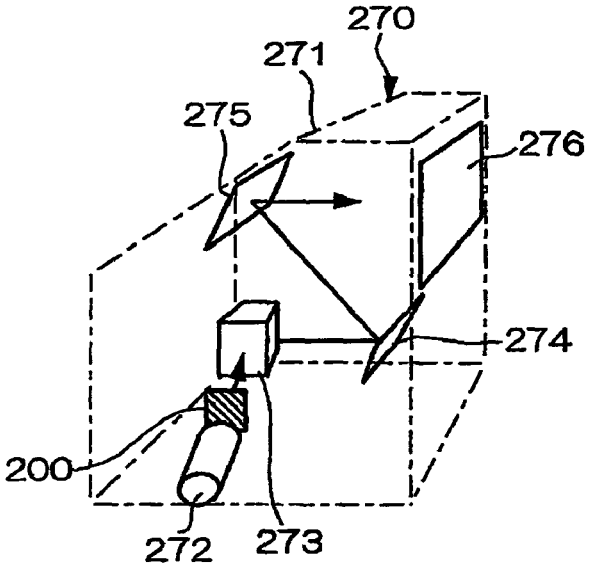

FIG. 16E shows a rear-type projector to which the above-mentioned electro-optical device is applied. A projector 270 includes a light source 272, a composition optical system 273, mirrors 274 and 275, a screen 276, and the electro-optical device 200 according to the invention, which are provided in a case 271.

Figure 16F:
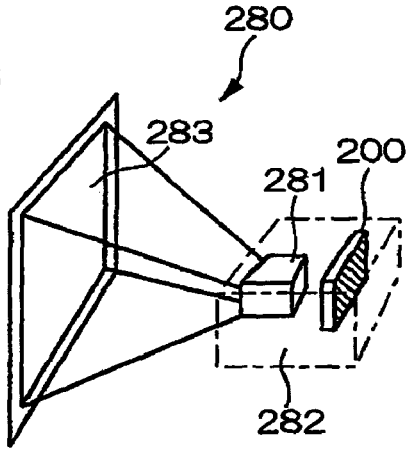

FIG. 16F shows a front-type projector to which the above-mentioned electro-optical device is applied. A projector 280 includes an optical system 281 and the electro-optical device 200 according to the invention provided in a case 282, and can display an image onto a screen 283.

Figure 17A:
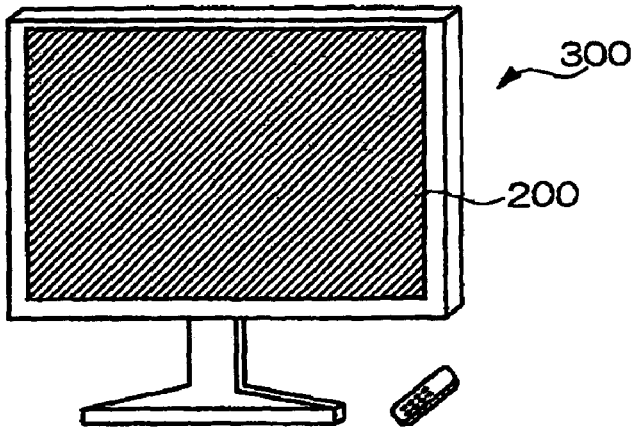
FIGS. 17A and 17B are diagrams illustrating examples of an electronic apparatus to which an electro-optical device can be applied.
Figure 17B:
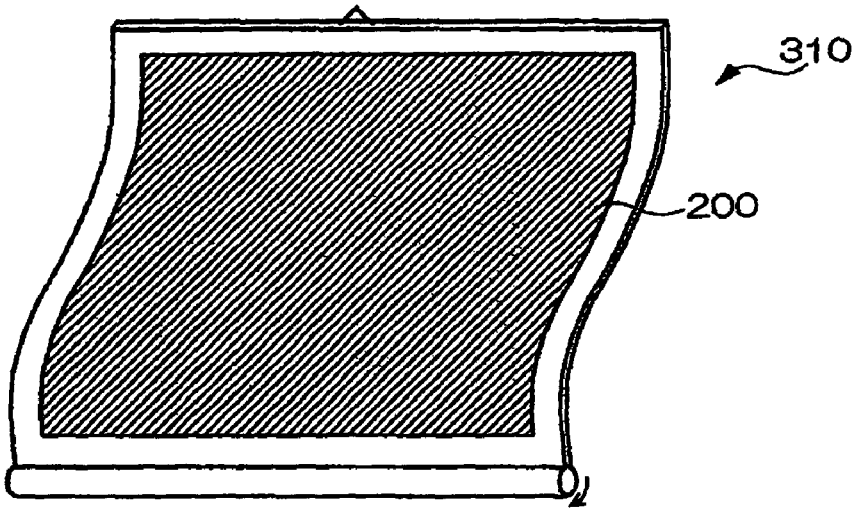

FIG. 17A shows a television to which the above-mentioned electro-optical device is applied. A television 300 includes the electro-optical device 200 according to the invention. In addition, the electro-optical device according to the invention can be applied to a monitor device used for a personal computer or the like. FIG. 17B shows a roll-up-type television to which the above-mentioned electro-optical device is applied. A roll-up-type television 310 includes the electro-optical device 200 according to the invention.

In a time division driving method using a current programming manner, since a comparator unit (comparator circuit) is used as a light-emitting time control unit for pixels, it is possible to avoid the complicated control operation.

Further, in the time division driving method using the current programming manner, since a one-input-type comparator unit (comparator circuit) is used as a light-emitting time control unit for pixels, it is possible to avoid the complicated control operation. In addition, it is possible to reduce the number of wiring lines and the number of elements constituting the pixel circuit.

What is claimed is:

1. A pixel circuit that makes an electro-optical element emit light and that receives a pixel signal, a ramp level signal and a signal corresponding to a light-emitting period of the electro-optical element, the pixel circuit comprising:

a drive current path having a current valve;

a first transistor inserted in the driving current path of the electro-optical element;

a current value setting circuit that sets the current value of the driving current path;

a level holder that stores the level of the pixel signal;

a comparison circuit that compares the level of the stored pixel image signal and the ramp level signal, outputs a comparison result and controls the operation time of the first transistor based on the comparison result;

a second transistor that is arranged in the driving current path in series with the first transistor and is conductively controlled by the signal corresponding to the light-emitting period of the electro-optical element; and a drive transistor that supplies a drive current corresponding to the current valve of the driving current path of the electro-optical element;

the comparison circuit including:

an output terminal, first and second input terminals, first and second power sources, a third transistor having a first polarity and a fourth transistor having a second polarity connected in series between first power source and second power sources with the output terminal being a node disposed between the third and fourth transistors;

a fifth transistor having a second polarity and a sixth transistor having a second polarity that are connected in series between the first input terminal to which the pixel signal is supplied and the second power source;

a seventh transistor having a second polarity and an eighth transistor having a second polarity that are connected in series between the second input terminal to which the ramp level signal is supplied and the second power source;

a first capacitance that is connected between a connection between the fifth and sixth transistors and a gate of the third transistor, and operates as the level holder;

a second capacitance that is connected between a connection point between the seventh and eighth transistors and a gate of the fourth transistor, and stores the level of the ramp level signal; and a ninth transistor having a second polarity, a first end and a second end, the first end of the ninth transistor being connected to the output terminal and the second end of the ninth transistor being connected to the gates of the third and fourth transistors, a first selection signal that instructs the storing of the level of the pixel signal being supplied to the respective gates of the fifth, eighth, and in the transistors, and a second selection signal, corresponding to the possible light-emitting period being supplied to the respective gates of the sixth and seventh transistors.

2. The pixel circuit as set forth in claim 1, the current value setting circuit including the drive transistor that is inserted in the drive current path, a current supply source that supplies a current of a predetermined value to the drive transistor, and a capacitor that holds a gate voltage of the drive transistor based on the current of the predetermined value supplied to the drive transistor.

3. The pixel circuit as set forth in claim 1, wherein the electro-optical element is an organic EL light-emitting element.

4. An electronic device, comprising the pixel circuit as set forth in claim 1 included in an image display device.

5. An electronic device, comprising the pixel circuit as set forth in claim 2 included in an image display device.

6. An electronic device, comprising the pixel circuit as set forth in claim 3 included in an image display device.

* * * * *